US005953792A

United States Patent [19]

Strobel et al.

[11] Patent Number: 5,953,792

[45] Date of Patent: Sep. 21, 1999

[54] GUIDE APPARATUS BETWEEN DELIVERY ROLLS AND CALENDER ROLLS

[75] Inventors: Michael Maria Strobel, Eichstätt; Wolfgang Göhler, Lenting, both of Germany

[73] Assignee: Rieter Ingolstadt Spinnereimaschinenbau AG, Ingolstadt, Germany

[21] Appl. No.: 09/158,862

[22] Filed: Sep. 23, 1998

[30] Foreign Application Priority Data

Sep. 26, 1997 [DE] Germany ..... 197 42 549

[51] Int. Cl.[6] ..... D01G 25/00; D04H 11/00

[52] U.S. Cl. ..... 19/150; 19/157; 19/159 R; 57/279; 57/280

[58] Field of Search ..... 19/150, 106 R, 19/144, 157, 159 R; 28/272; 57/261, 279, 280, 304

[56] References Cited

U.S. PATENT DOCUMENTS

| | | |
|---|---|---|
| 3,246,370 | 4/1966 | West . |
| 4,949,431 | 8/1990 | Gasser . |
| 5,406,679 | 4/1995 | Leifeld et al. . |
| 5,666,698 | 9/1997 | Nauthe et al. . |
| 5,680,678 | 10/1997 | Nauthe et al. . |
| 5,689,856 | 11/1997 | Nauthe et al. . |

FOREIGN PATENT DOCUMENTS

| | | |
|---|---|---|
| 3333142A1 | 6/1984 | Germany . |
| 3436526A1 | 4/1986 | Germany . |
| 290679 A5 | 6/1991 | Germany . |

OTHER PUBLICATIONS

German Patent Office Search Report, Mar. 18, 1998.
German Patent Office Search Report, Mar. 8, 1999.

*Primary Examiner*—John J. Calvert
*Assistant Examiner*—Gary L. Welch
*Attorney, Agent, or Firm*—Dority & Manning

[57] ABSTRACT

A guide apparatus (1) for the fiber band of a textile machine which processes fibers, is situated between a pair of delivery rolls and a pair of calender rolls. The guide apparatus (1) exhibits a nozzle assembly (2, 3) with respective guide passage axes (6, 15) which form a guide path, and which nozzle sections (2, 3) are pivotally connected at their facing contacting surfaces (9, 11). The guide passage axes (6, 15) of the nozzle sections (2, 3) are angularly offset to one another, whereby at least one nozzle section (2) is pivotable from a start-up position into an operating position about a designed pivoting axis at right angles to the guide passage axes (6, 15). In the connective position, the contacting surfaces of the nozzle sections (2, 3) lie form fit and sealingly tight against one another, and in the operational position the nozzle sections (2, 3) form at least an aperture (S), preferably in the area of the contact surfaces (9, 11).

6 Claims, 3 Drawing Sheets

FIG. 2
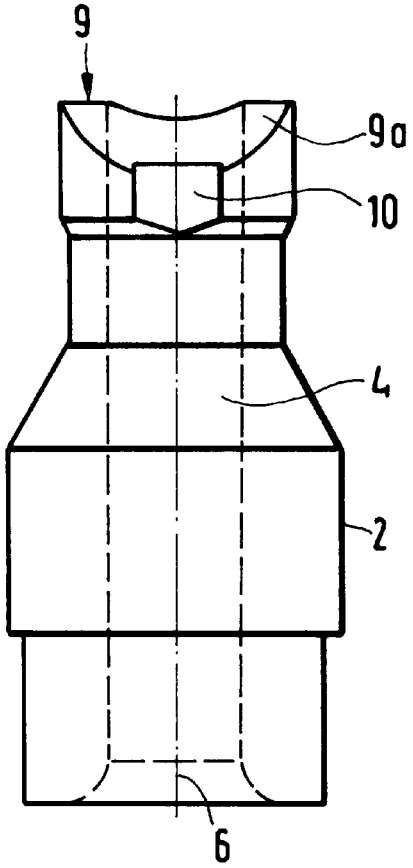
FIG. 3
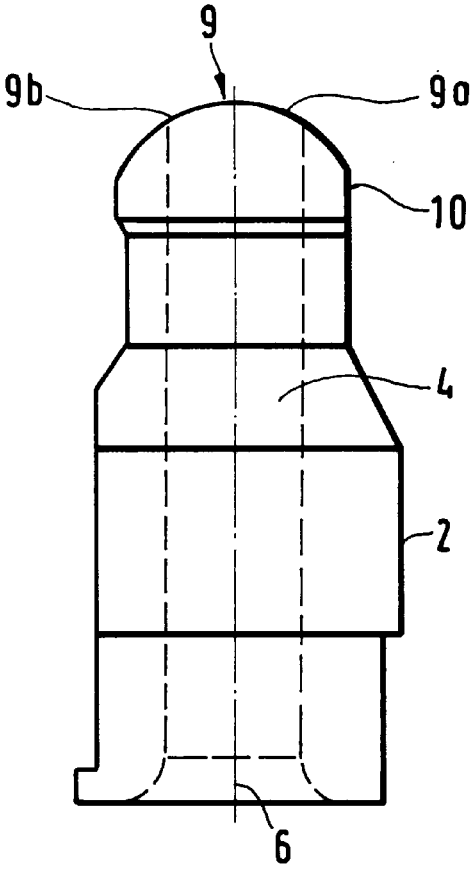
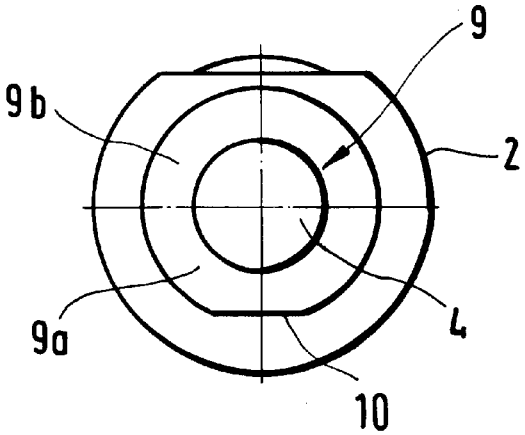
FIG. 4

GUIDE APPARATUS BETWEEN DELIVERY ROLLS AND CALENDER ROLLS

The invention concerns a fibre band guide apparatus for a textile machine which processes fiber bands and a procedure for the operation of such guide.

In the current state of the technology, EP 736 620 A1 has made known a guide apparatus for fiber band for a textile machine which processes fiber band. The guide apparatus is placed between a pair of delivery rolls and a pair of calender rolls, wherein the guide apparatus possesses nozzle sections, which form a guide passage. The nozzle section through which the fiber band must first run is the forward nozzle section and the following nozzle section is the rear nozzle. The forward nozzle section is assigned to a matting hopper, the rear nozzle section to a band hopper.

The guide passage has an angular course of travel, because the forward nozzle section is fastened angularly to the rear nozzle section. The forward nozzle section is pivotable between a start-up position and an operative position in relation to the rear nozzle section.

The forward nozzle section has a swivelling surface on its opening. This swivelling surface is formed symmetrically and is comprised of two narrowing, curved surface segments extending backwards, as opposed to the transport direction of the fiber band, and fit into a corresponding receiving surface of the rear nozzle section. The receiving surface is formed on the entry opening of the rear nozzle section. The forward nozzle section, with its swivelling surface, form-fits tightly into the receiving surface of the rear nozzle section. At this point, the two sections make a swivelling joint. The opening of the forward nozzle section and the tapering band guide area of the rear nozzle section, inside the guide passage form a swivelling joint zone.

Not only during the swivelling of the forward nozzle section into the start-up position, but as well as during the swivelling into the operation position, the joint always remains air tight in accordance with the EP 736 620 A1.

The band hopper, (rear nozzle section) can also be employed as a measurement entity for determining the thickness of the fiber band. In regard to this aspect, a sensor can be placed in the rear nozzle section (of the band hopper). Such a sensor can, for instance, be a wire strain gauge. The installation of such a sensor affects the formulation of the guide passage in the rear nozzle section. In particular, the original tapering band guiding zone of the rear nozzle section is designed asymmtrically. This leads to changed flow relationships in the joint zone of the guide passage.

In the case of working with low quality natural fibers, especially natural fibers strongly retaining mineral dusts, particulate deposits can build up in the joint area between the forward nozzle section and the rear nozzle section. These deposits break up and form localized strong contaminations on the fiber band, which adversely affect a subsequent measurement of the fiber band thickness. In particular, in the case of automated stretch works, this can lead to delays and faulty regulation or to failure in quality control.

OBJECTS AND SUMMARY OF THE INVENTION

Thus a principle purpose of the invention is to avoid the presence of deposits and particulate from the fiber band in the guide passage of the guide apparatus. Additional objects and advantages of the invention will be set forth in part in the following description, or may be obvious from the description, or may be learned through practice of the invention.

The purposes can be achieved by a guide apparatus and by a procedure in accordance with the invention.

The guide apparatus according to the invention exhibits nozzle sections with respective axes, which said sections form a guide passage, wherein the nozzle-sections, with their contact surfaces turned to one another, are swivelly jointed together. The guide axes of the nozzle sections are angularly offset to one another, and at least one nozzle section is pivotable from a start up position to an operating position about an axis which is at right angles to the guide passage axes.

In accord with the invention, in the start-up position, the contact surfaces of the nozzle sections are tightly form-fit, while in the operational position, the nozzle sections form at least one aperture breaking the seal, advantageously in the area of their said contact surfaces. Experience has shown that the air in the joint area of the contact surfaces of the nozzle sections builds up a deposit, especially on the edges of the joint area where turbulence occurs. These turbulent areas lead to dust deposits, which deposits break up at certain grain sizes and contaminate the fiber band. Since these deposits and particles continually build up anew during the operation, the danger of the formation of faulty measurement signals, as a result of greater sized particles in the fiber band, is avoided by the present invention.

The invention makes it possible that in the operational position, by means of the aperture, an opening is made from the guide passage to the outside. Upon a reverse pivoting back into the start-up position, the aperture is self closing, that is the joint area is substantially radially air tight. This is necessary for the automatic introduction of bands.

For the design of a sphere-like joint, in the area of the contact surface of the nozzles, the contact surface of the one nozzle section is made convex, and the contact surface of the other nozzle section shaped concave, whereby the two contact surfaces lie against one another in an entirely, or partially, shape and functionally complementary manner. "Shape and function complementarity" here means that the contact surface is so shaped that it comes to rest against the other contact surface in a form-governed, sealing manner. By this means, assurance is given that in the start-up position the guide passage is laterally close and in the operational position exhibits an aperture of the closure.

Furthermore, it is advantageous if the convex contact surface of the nozzle section is constructed asymmetrically because of a recess. This recess can be made, for instance, by means of a bevel, or a planing off on the contact surface of a nozzle section. By means of the cutting away of material in the area of the contact surfaces, the previously known nozzle sections can be easily converted into nozzle sections in accord with the invention.

The nozzle section is shaped asymmetrical by the recess, i.e. by the removal of material, so that in the start-up position the aperture is closed and in the operational position, is open.

The recess of the nozzle section can be designed as a plane surface. Also, the recess can be carried out as a dished surface or be in some other geometric form. The decisive factor is that, due to the recess, the contact,surface is diminished, so that, in the operational position, the guide apparatus provides an opening in the guide passage. This opening possesses preferably the size of a crack and favorably reduces thereby the build up of the air in the area of the joint. During operation, the air can escape from the guide passage through the opening. Furthermore, dust from the fiber material and other particulate can be conducted to the outside of the guide apparatus, whereby the danger of scale formation depositioning on the threads being made s substantially reduced.

In order to further diminish contamination, in the guide apparatus and the fiber band, in most cases, a nozzle section exhibits at least a preferably tapered, expanding passage segment at the transition zone to the other nozzle section. In addition, air turbulence in the guide passage is effectively prevented, i.e. substantially reduced.

Where the procedure is in accord with the invention, during the start-up upon introducing a fiber band, the guide passage of the guide apparatus is laterally closed and subsequently in the operational mode an aperture in the guide passage is opened. By this means, air turbulence and particulate depositions in the guide passage are avoided, so that the fiber band is not contaminated. This has the result that measurement signals become "fail-free" as a result of fewer interfering deposits in the fiber band.

In an advantageous development, wherein the guide apparatus possesses nozzle sections which-form the guide passage, the aperture is opened and closed by the pivoting of a nozzle section about a swivelling axis. In this case, it is not necessary that additional valves or dampers must be opened and closed by controls. The aperture is self closing and opening by means of the pivoting action of at least one of the nozzle sections.

The pivoting axis is preferably designed at right angles to the glide passage, i.e. perpendicular to the guide passage axes.

The backup of air in the guide passage and the contamination by means of particulate is prevented, inasmuch as the air and/or particles are expelled from the guide passage through the aperture. At the same time, much air turbulence is avoided. Further, the removal of particulate from the guide passage takes care that the fiber band is not contaminated.

BRIEF DESCRIPTION OF THE DRAWINGS

An embodiment of the invention is presented in the drawings and is described more closely in the following, there is shown in:

FIG. 2 a front view of a forward nozzle section,

FIG. 3 a side view of a forward nozzle section.

FIG. 4 an opening of the forward nozzle section,

DETAILED-DESCRIPTION

Figure 1:
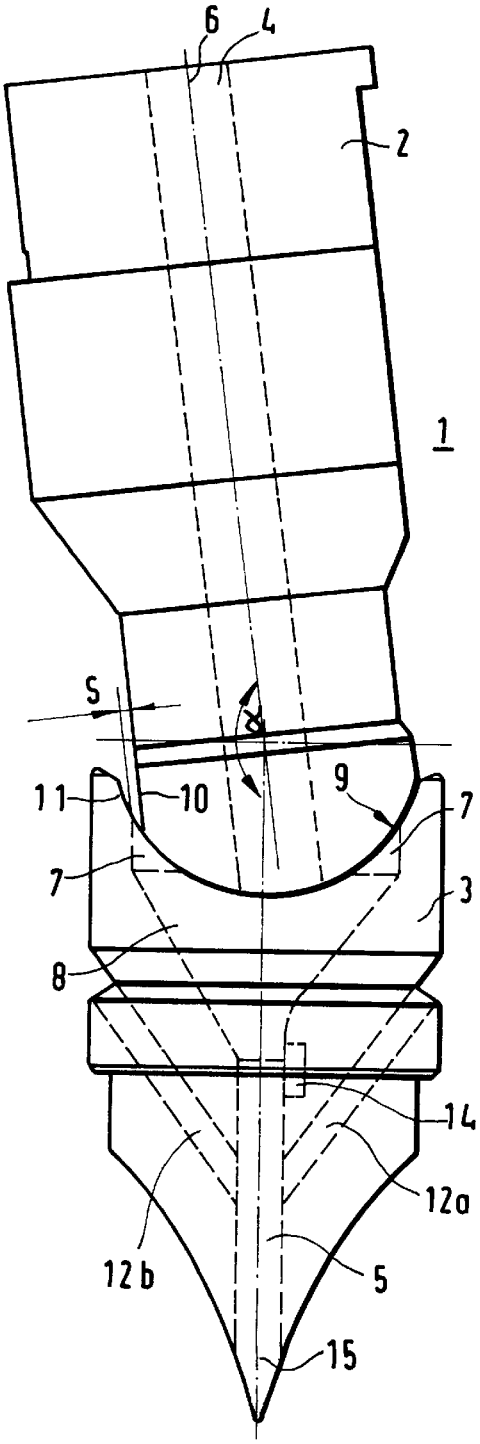
FIG. 1 a guide apparatus in the operational position.

Reference will now be made in detail to the presently preferred embodiments of the invention, one or more examples of which are shown in the drawings. Each example is provided by way of explanation of the invention, and not meant as a limitation of the invention. For example, features illustrated or described as part of one embodiment, may be used with another embodiment to yield still a further embodiment. It is intended that the present invention include such modifications and variations.

FIG. 1 shows, in sectional view, a guide apparatus 1, comprised of a forward nozzle section 2 with a passage 4 and a rear nozzle section 3, with its passage 5. The forward nozzle section 2 is set into a (not shown) matting hopper and a fiber band runs first through this nozzle section 2. The rear nozzle section 3 forms an insert in a band hopper, which, likewise, is not shown. Upon batch switching, the nozzle sections, singly or together, are exchangeable with substitutes, so that a guide passage, which is composed of the passages 4, 5 of the nozzle sections 2, 3, can have a diameter which best accommodates the fiber material.

The passages 4, 5 of the nozzle sections 2, 3 exhibit longitudinal axes 6, 15, which are angularly offset in reference to on another. The forward nozzle 2 possesses further a contact surface 9, which is designed as a convex surface. The contact surface 9 is comprised of two symmetrically arranged, curved surface areas 9*a*, 9*b* (FIG. 3). These surface areas 9*a* and 9*b* are two narrowing, continually curved surface sections, which inter connect in a corresponding contact surface 11 of the rear nozzle section 3.

The forward nozzle section 2 and the rear nozzle section 3 are tightly form fitting and pivotably joined by their contact surfaces 9, 11. The rear nozzle section 3 is designed with a band guide area 8 which is formed asymmetrically, if a placement of a sensor 14 is therewith integrated. Because of a turbulence in flow, which this asymmetry causes, the area is favorable to scale deposition, which upon reaching a certain grain size breaks off and contaminates the fiber band.

FIG. 2 shows an individual view of the forward nozzle section 2. There may be recognized here a passage segment 4 with a figurative longitudinal axis 6.

The opening of the forward nozzle section 2 exposes the surface area 9*a* with the swivel joint surface 9. This surface segment 9*a* of the swivel surface 9 is reduced by a recess 10 opposite the surface section 9*b*.

FIG. 3 shows a side view of, again, the forward nozzle section 2 of FIG. 2. It is clearly to be seen here, that the joint surface 9 is convexly curved and possesses two surface sections 9*a* and 9*b* symmetrically disposed to a figurative mid-plane in the longitudinal axis 6.

FIG. 4 is a plan view demonstrating the opening of the forward nozzle section 2. Here is shown that the surface sections 9*a* and 9*b* form the pivoting joint surfaces. By means of the recess 10, the surface section 9*a* is diminished by a plane-surface formed parallel to the longitudinal axis 6. Other placements of a plane are also possible, which lead to a diminishing of the surface section 9*a*.

As may be seen further in FIG. 1, in the operational position of the forward nozzle section 2, at the recess 10 and the matching surface 11 an aperture S is formed.

Figure 5:
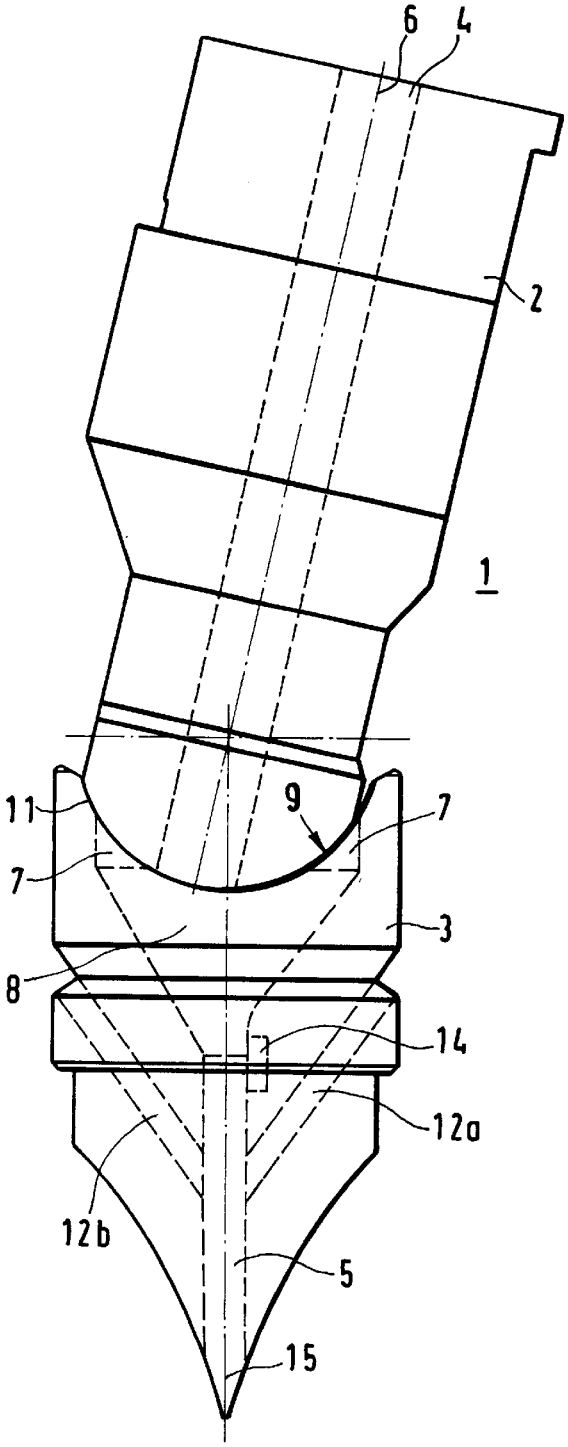
FIG. 5 the guide apparatus in the start-up position.

FIG. 5 shows the forward nozzle section 2 in a startup position. Made obvious here, is that in spite of recess 10, the aperture S remains closed. This is also practical, because in the startup mode, the fiber band is automatically threaded into the system. For this procedure, a suction is required, which acts through the passages 12*a* and 12*b*, so that a radial opening of the guide passage would be disadvantageous. Only in the operational position, (FIG. 1) of the forward nozzle section is the aperture S formed.

Figure 6:
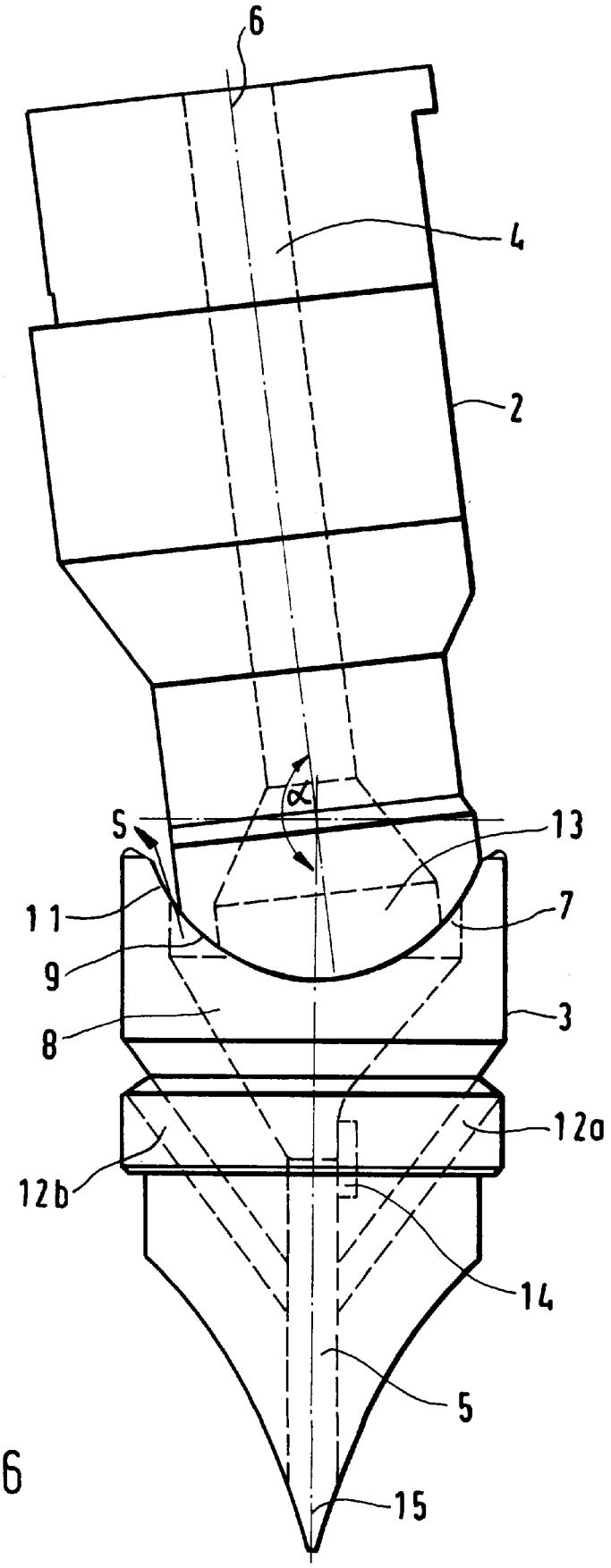
FIG. 6 a forward nozzle section with tapered extension.

FIG. 6 shows a favorable embodiment of the invention. The forward nozzle section 2 has the recess 10 and forms the aperture S. Furthermore, the passage section 4 of the forward nozzle section 2 in the area of its opening is tapered and extended, that is, the opening has a conical widening 13. This arrangement allow that the dead zones of the turbulent areas 7 are clearly diminished. Simultaneously, the space for incrustations is noticeably reduced. The turbulent zone 7 is substantially reduced.

It should be apparent to those skilled in the art that varios modifications and variations can be made in the present invention without departing from the scope and spirit of the invention. It is intended that the present invention include such modifications and variations as come within the scope of the appended claims and their equivalents.

Claimed is:

1. A guide apparatus for guiding a fiber band in a textile machine, comprising:

at least two adjacent nozzle sections pivotally connected at facing contacting surfaces, each said nozzle section comprising a guide passage therethrough for a fiber band and wherein said guide passages of said adjacent nozzle sections are disposed angularly offset;

one of said nozzle sections pivotal from a start-up position to an operational position; and wherein in said start-up position said contacting surfaces of said nozzle section are in a sealed form fit engagement so that air generally does not escape from said guide passages through said contacting surfaces, and in said operational position said pivotal nozzle is moved to a position so that an aperture is formed in the are of said contacting surfaces into at least one of said guide passages so that air escapes from said guide passages through said aperture.

2. The guide apparatus as in claim 1, wherein said contacting surfaces comprise complimentary convex and concave surfaces defined on said respective nozzle sections.

3. The guide apparatus as in claim 2, wherein said convex contacting surface comprises a recess defined therein, said recess defining said aperture in said operational position of said nozzle sections.

4. The guide apparatus as in claim 3, wherein said recess is defined as one of a generally flat planar or dished surface.

5. The guide apparatus as in claim 1, wherein said guide passage of at least one of said nozzle sections comprises an expanding passage section at the point of transition to said other nozzle section.

6. The guide apparatus as in claim 4, wherein said expanding passage section is a conically expanding passage section.

* * * * *